United States Patent [19]

Wu

[11] Patent Number: 4,946,383

[45] Date of Patent: Aug. 7, 1990

[54] AMUSEMENT LIGHTER

[76] Inventor: Matthew Wu, 1F., No. 10-3, Lane 180, Tzu Chyang St., Pei Tou District, Taipei, Taiwan

[21] Appl. No.: 460,476

[22] Filed: Jan. 3, 1990

[51] Int. Cl.[5] ..... F23Q 2/00

[52] U.S. Cl. ..... 431/125; 431/253; 431/255

[58] Field of Search ..... 431/125, 126, 253, 255

[56] References Cited

U.S. PATENT DOCUMENTS 4,471,404 9/1984 Hitta ..... 431/255

*Primary Examiner*—Carroll B. Dority

*Attorney, Agent, or Firm*—Varndell Legal Group

[57] ABSTRACT

An amusement lighter, which includes a L-shaped push rod to drive a piezoelectric switch to discharge sparks for ignition, and simultaneously to drive a gear driving device to carry five wheels which have a variety of patterns printed thereon, to rotate just like a slot machine. A movable pressure plate is attached the lighter so that the piezoelectric switch and the flame hole of the lighter can be stopped when the lighter is fastened to one's clothing for carriage.

2 Claims, 3 Drawing Sheets

AMUSEMENT LIGHTER

BACKGROUND OF THE INVENTION

The present invention relates to an amusement lighter and more particularly to a lighter which can be used for making a fire and simultaneously for amusement.

The lighter is a device used to start something burning. In order to attract consumers to buy, all lighter manufacturers are doing their best in improving the design and quality of the lighter. However, any improvement in structure gives little change on the function of the lighter. Further, the conventional piezoelectric lighter is very dangerous in use. Error trigger of the piezoelectric switch may cause big trouble.

An object of the present invention is to provide a lighter which can be simultaneously used as an amusement device.

Another object of the present invention is to provide a lighter which is inexpensive to manufacture and safe in use.

Still another object of the present invention is to provide a lighter which is convenient for carriage with oneself and good for serving as an ornament.

An embodiment of amusement lighter according to the present invention includes a housing having mounted thereon a L-shaped push rod for driving a piezoelectric switch therein to discharge sparks for ignition, and simultaneously for driving a gear driving device therein to carry five wheels to rotate. The wheels have a variety of patterns printed thereon. When they are driven to rotate, a variety of patterns will be alternatively presented through a show window on the housing of the lighter. A movable pressure plate is attached the lighter so that the piezoelectric switch and the flame hole of the lighter can be stopped when the lighter is fastened to one's clothing for carriage.

The present invention will now be described by way of example, with reference made to the annexed drawings, in which:

DETAILED DESCRIPTION OF THE PREFERRED EMBODIMENTS

Figure 1:
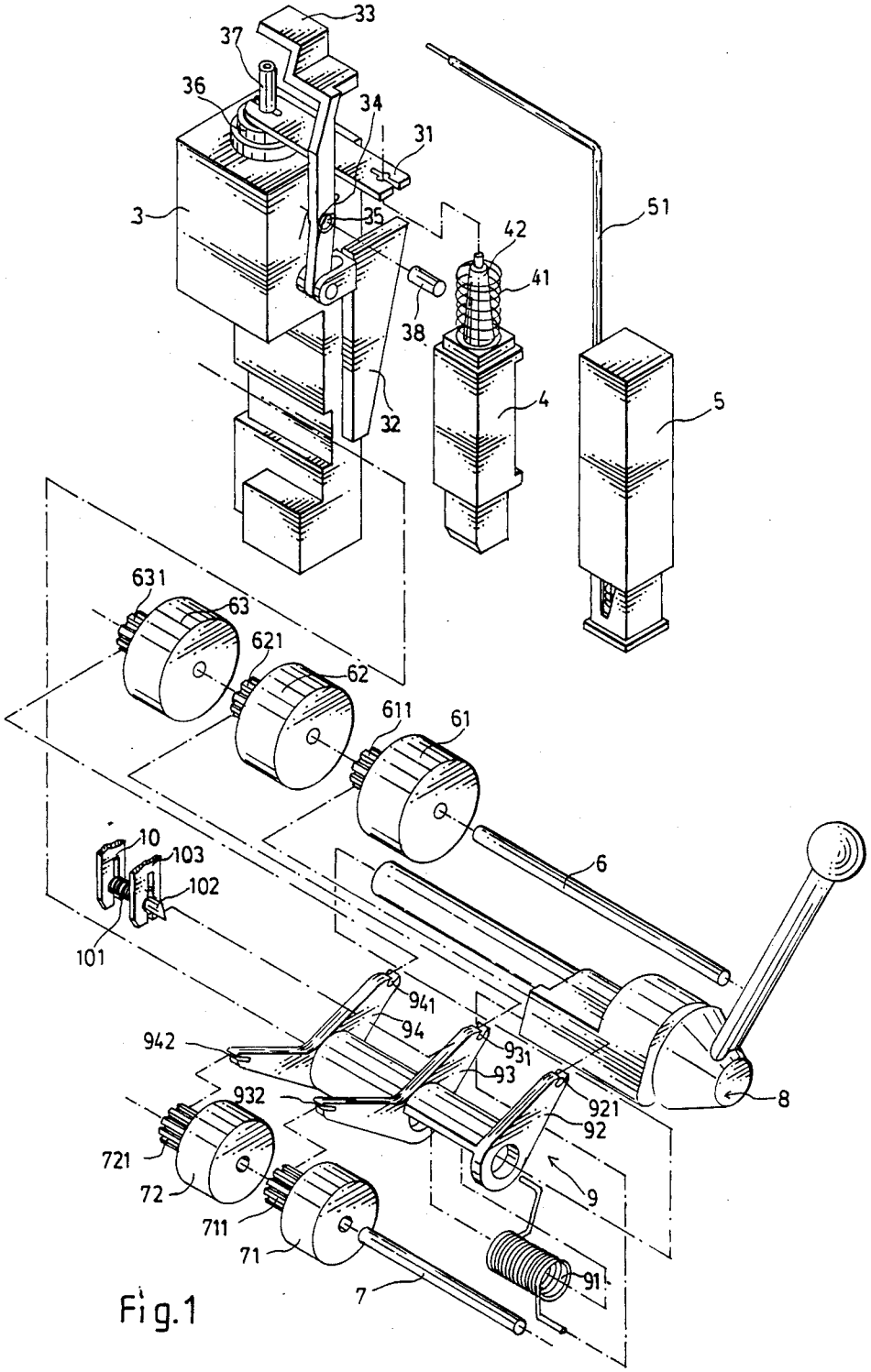
FIG. 1 is a partly perspective exploded view of an amusement lighter in accordance with the present invention.
Figure 2:
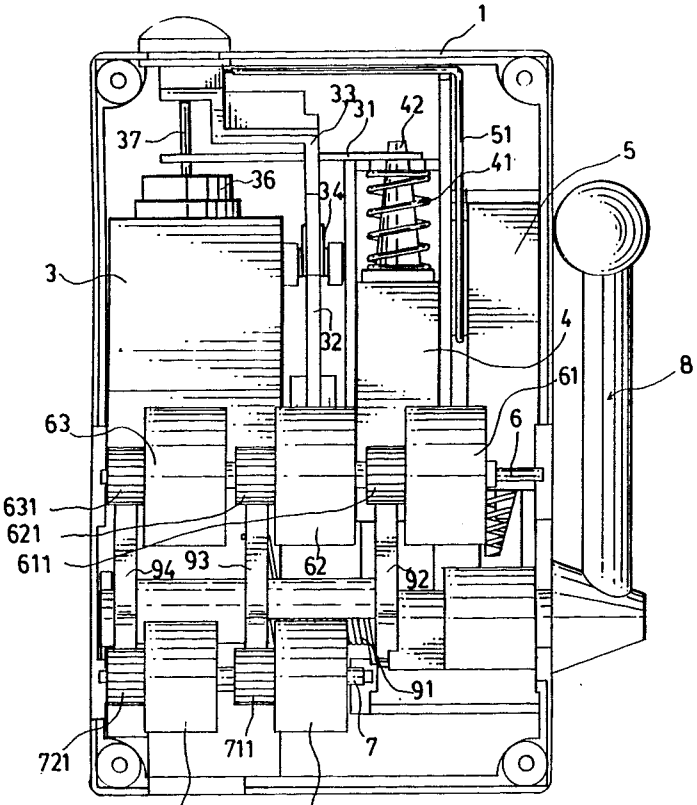
FIG. 2 is a plan view of the amusement lighter of FIG. 1, illustrating the interrelation of the inner component parts thereof.
Figure 4:
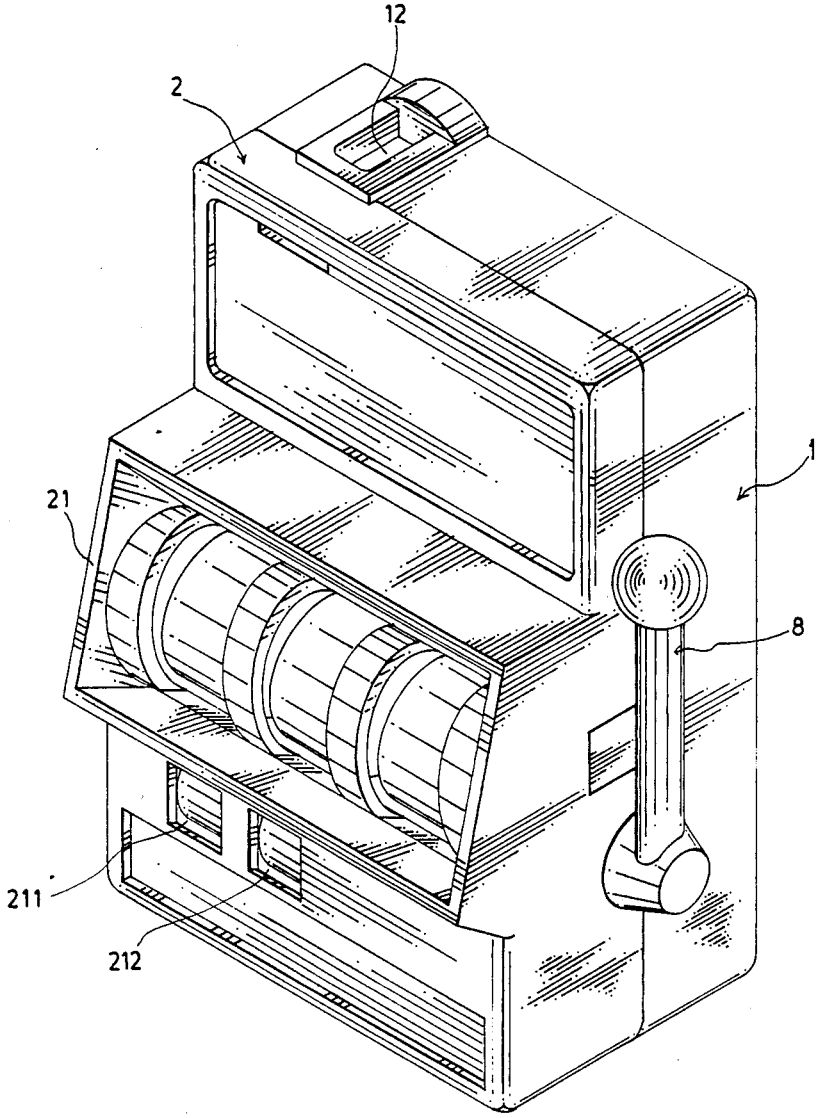
FIG. 4 is a perspective assembly view illustrating the outer configuration of the amusement of FIG. 1.

Turning now to the annexed drawings in greater detail and referring first to FIGS. 1 and 2, there is a gas tank (3) set in a rectangular bottom shell (1) at a left side. A rectangular flame hole (12) is made on the bottom shell (1) right above the gas tank (3). A triangular pressure plate (32) is set at the right side of the gas tank (3). A ladder-like shielding plate (33) which extends upwardly from the pressure plate (32) is secured to the gas tank (3) by means of a torque spring (34) and a pin (38) through a hole (35) thereon. A nozzle (37) which extends upwardly from the gas tank (3) is normally pressed by the ladder-like shielding plate (33). A regulating ring (36) which comprises an unitary regulating knob (361) is mounted on the nozzle (37) and connected to the top surface of the gas tank (3). A rectangular control plate (31) which is mounted on the nozzle (37) and set right above the regulating ring (36) is connected to a propulsive device (4) which is set at the right side relative to the control plate (31) and comprises an elongated conical top end (42) having a compression spring (41) thereon. A piezoelectric switch (5) is set at the right side relative to the propulsive device (4) with its ignition wire (51) received in the top underbottom of the bottom shell (1). Three wheels (61), (62) and (63) which have a variety of patterns respectively printed on the face thereof and comprise each an external gear (611), (621) or (631) are sleeved on a positioning rod (6) which is transversely mounted on the bottom shell (1) in a middle position. Another two wheels (71) and (72) which are identical to the said three wheels (61), (62) and (63) in structure and have each an external gear (711) or (721) are sleeved on another positioning rod (7) which is transversely mounted on the bottom shell (1) right below and in parallel with the said three wheels (61), (62) and (63). An L-shaped push rod (8) which has thereon a torque spring (91) and a gear driving device (9) is set in the bottom shell (1) between the wheels (61), (62) and (63), and the wheels (71) and (72). The gear driving device (9) comprises a pair of V-shaped plates (93) and (94) and an end plate (92) spaced from one another at equal distance, wherein the V-shaped plates (93) and (94) have such a common contained angle that the notches (921), (931), (941), (932) and (942) thereof are respectively engaged with the gears (611), (621), (631), (711) and (721). A rectangular front shell (2) is mounted on bottom shell (1) to contain the said parts therebetween. Referring to FIG. 4, the front shell (2) comprises a slant show window (21) through which the patterns on the wheels (61), (62), and (63) can be clearly seen, and two small display holes (211) and (212) for the display of the two lower wheels (71) and (72). Two supporting plates (10) and (103) are set in the front shell (2) corresponding to the two lower wheels (71) and (72). A sliding rod (102) which has a spring (101) thereon is transversely mounted on the two supporting plates (10) with its spring (101) squeezed in therebetween. The sliding rod (102) has a slant front end which protrudes beyond the supporting plate (103) and is connected to the V-shaped plate (93). The bottom shell (1) also comprises a hole (11) through which the regulating knob (361) of the regulating ring (36) protrudes therebeyond. A rectangular hole (321) is made on the bottom shell (1) permitting the moving therethrough of the pressure plate (32). A torque spring (22) is mounted on the back side wall of the bottom shell (1) corresponding to the pressure plate (32) and connected to a clip (20) through which the present amusement lighter can be conveniently attached to one's pocket or certain part of one's clothing.

Figure 3:
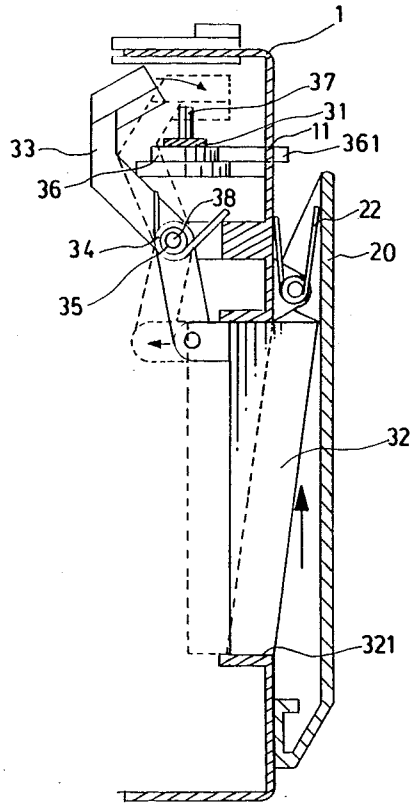
FIG. 3 is a side-elevation of the amusement lighter of FIG. 1.

Referring to FIGS. 1 and 3 again, the turning of the push rod (8) drives the propulsive device (4) and the piezoelectric switch (5) to turn on the control plate (31) permitting the flowing of gas out of the nozzle (37). As soon as gas flows out of the nozzle (37), it is immediately burned by means of the sparks discharged from the piezoelectric switch (5). Upon turning of the push rod (8), the torque spring (91) thereon is simultaneously squeezed to reserve energy and force the gear driving device (9) to rotate downward. During downward rotation of the gear driving device (9), the V-shaped plate

(93) moves through the slant front end of the sliding rod (102) to drive the three upper wheels (61), (62) and (63) and the two lower wheels (71) and (72) to rotate. Because of the effect of torque spring (91) and the rapid return of the sliding rod (102), the push rod (8) and the gear driving device (9) are forced to rapidly rotate backward to original position. When the clip (20) is opened to clamp on one's clothing, the pressure plate (32) is turned inward to simultaneously turn the shielding plate (33) to block up the piezoelectric switch (5) from the nozzle (37) and close up the flame hole (12). Under this condition, erroneous triggering of the push rod (8) does not make flame.

For amusement only, the regulating knob (361) of the regulating ring (36) is turned to off position. When the regulating ring (36) is turned to off position, the turning of the push rod drives the wheels (61), (62), (63), (71) and (72) to rotate but does not produce flame. When the amusement lighter is in wear, the slant show window (21) is exposed outside for the showing of the inner wheels.

What is claimed:

1. A lighter, including a bottom shell having set therein a gas tank at its left side, a rectangular flame hole right above said gas tank, a triangular pressure plate at the right side of said gas tank, a ladder-like shielding plate extending upwardly from said pressure plate and being secured to said gas tank by means of a torque spring and a pin through a hole thereon, a nozzle extending upwardly from said gas tank and pressed by said shielding plate, a regulating ring which comprises an unitary regulating knob being mounted on said nozzle for gas flow regulation, a rectangular control plate mounted on said nozzle above said regulating ring and connected to a propulsive device, said propulsive device having an elongated conical top end mounted with a compression spring thereon, a rectagular hole for the passing therethrough of said pressure plate, a piezoelectric switch at the right side relative to said propulsive device, three upper wheels having a variety of patterns respectively printed on the face thereof being sleeved on a first positioning rod set in the middle, two lower wheels having a variety of patterns printed thereon and being sleeved on a second positioning rod set right below and in parallel to said three upper wheels, a L-shaped push rod having thereon a torque spring and a gear driving device being set between said three upper wheels and said two lower wheels, said gear driving device comprising a pair of V-shaped plates and an end plate having notches thereon respectively engaged with said three upper wheels and said two lower wheels, a clip attached at the back side and including a torque spring for fastening, and a rectangular front shell mounted on said bottom shell, said front shell comprising a slant show window through which the patterns on said three upper wheels can be clearly seen, two small display holes through which the patterns on said two lower wheels can be presented, two supporting plates set in said front shell corresponding to said two lower wheels, a sliding rod which has a spring thereon being transversely mounted on said two supporting plates with its spring squeezed in therebetween, said sliding rod having a slant front end protruding beyond said supporting plates to connect to said V-shaped plates.

2. A lighter as claimed in claim 1, wherein said three upper wheels and said two lower wheels have each a gear at the left side relatively in a smaller diameter and respectively engaged with the notches of said gear driving device.

* * * * *